US009011166B2

(12) United States Patent
Zhang

(10) Patent No.: US 9,011,166 B2
(45) Date of Patent: Apr. 21, 2015

(54) ELECTRONIC DEVICE AND CONNECTOR MODULE

(71) Applicant: Wistron Corporation, New Taipei (TW)

(72) Inventor: Dan-Dan Zhang, New Taipei (TW)

(73) Assignee: Wistron Corporation, New Taipei (TW)

( * ) Notice: Subject to any disclaimer, the term of this patent is extended or adjusted under 35 U.S.C. 154(b) by 150 days.

(21) Appl. No.: 13/925,845

(22) Filed: Jun. 25, 2013

(65) Prior Publication Data

US 2014/0349498 A1 Nov. 27, 2014

(30) Foreign Application Priority Data

May 22, 2013 (CN) ..... 2013 1 0192701

(51) Int. Cl.
*H01R 13/52* (2006.01)

(52) U.S. Cl.
CPC ..... *H01R 13/5213* (2013.01)

(58) Field of Classification Search
CPC ..... H01R 13/5213
See application file for complete search history.

(56) References Cited

U.S. PATENT DOCUMENTS 8,589,963 B2 * 11/2013 Wang ..... 720/647
2013/0058056 A1 3/2013 Fan
2014/0349498 A1 * 11/2014 Zhang ..... 439/136

* cited by examiner

*Primary Examiner* — James Harvey
(74) *Attorney, Agent, or Firm* — Jianq Chyun IP Office

(57) ABSTRACT

An electronic device includes a casing and a connector module. The casing has a notch. The connector module includes a connector main body, a cover, a first position-limiting portion, a second position-limiting portion and an elastic component. The connector main body is disposed on the casing and corresponding to the notch. The cover is pivoted with the casing. The cover is adapted to rotate to a first position to cover the notch or rotate to a second position to expose the notch. The first position-limiting portion has at least one position-limiting hole. The first position-limiting portion and the second position-limiting portion have a gap therebetween. The elastic component is disposed in the gap and partially inserted into the position-limiting-hole. The cover presses the elastic component on the casing and is adapted to restore from the second position to the first position by elastic force of the elastic component.

20 Claims, 5 Drawing Sheets

ELECTRONIC DEVICE AND CONNECTOR MODULE

CROSS-REFERENCE TO RELATED APPLICATION

This application claims the priority benefit of China application serial no. 201310192701.5, filed on May 22, 2013. The entirety of the above-mentioned patent application is hereby incorporated by reference herein and made a part of this specification.

FIELD OF THE INVENTION

The present invention relates to an electronic device and a connector module thereof, and more particularly to an electronic device and a connector module thereof having an elastic component.

DESCRIPTION OF RELATED ART

With the rapid development of science and technology, the portable electronic device such as tablet PC or notebook computer (NB) has been widely used due to the advantage of portable carrying and operation simplicity. Most of the notebook computers are equipped with network connectors for connecting, for example, RJ45-type plug of network cable.

A network connector of a notebook computer is mostly disposed at a side edge of the host. To meet the developing trend of lightness and slimness, many notebook computers adopt the design of half-sectional network connectors. In the design of a half-sectional network connector, a bottom casing of a notebook computer has a notch. A part of the network connector corresponds to the notch, and a cover disposed on the bottom casing covers the notch. When the cover is expanded to expose the notch, a plug of a network cable may be plugged into the network connector. In general, the cover needs to be restored automatically by elasticity of an elastic component after being expanded. In the conventional design, the elastic component is usually fixed by the components fused to the bottom casing. Accordingly, the complication of the assembly is increased, and the component is hard to be disassembled or replaced due to the fusion process.

SUMMARY OF THE INVENTION

The present invention provides an electronic device, which the connector module thereof is easy to be assembled and disassembled.

The present invention provides a connector module easy to be assembled and disassembled.

An electronic device of the present invention includes a casing and a connector module. The casing has a notch. The connector module includes a connector main body, a cover, a first position-limiting portion, a second position-limiting portion and an elastic component. The connector main body is disposed on the casing and corresponds to the notch. The cover is pivoted with the casing. The cover is adapted to rotate to a first position to cover the notch, or rotate to a second position to expose the notch. The first position-limiting portion and the second position-limiting portion are connected to the casing. The first position-limiting portion has at least one position-limiting hole. A gap is formed between the first position-limiting portion and the second position-limiting portion. The elastic component is disposed at the gap and partially inserted into the position-limiting hole. The cover presses the elastic component onto the casing and is adapted to restore from the second position to the first position by elastic force of the elastic component.

A connector module of the present invention is adapted for an electronic device is provided. The electronic device includes a casing, and the casing has a notch. The connector module includes a connector main body, a cover, a first position-limiting portion, a second position-limiting portion and an elastic component. The connector main body is disposed on the casing and corresponds to the notch. The cover is pivoted with the casing. The cover is adapted to rotate to a first position to cover the notch, or rotate to a second position to expose the notch. The first position-limiting portion and the second position-limiting portion are connected to the casing. The first position-limiting portion has at least one position-limiting hole. A gap is formed between the first position-limiting portion and the second position-limiting portion. The elastic component is disposed at the gap and partially inserted into the position-limiting hole. The cover presses the elastic component onto the casing and is adapted to restore from the second position to the first position by elastic force of the elastic component.

According to an embodiment of the present invention, the elastic component is a torsion spring and includes at least one spring body, at least one first spring arm and a second spring arm. The spring body is connected between the first sprig arm and the second spring arm and located at the gap. The first spring arm is inserted into the position-limiting hole, and the cover leans against the second spring arm.

According to an embodiment of the present invention, the first position-limiting portion and the second position-limiting portion restrain a moving range of the elastic component along a first direction. The position-limiting hole restrains moving ranges of the elastic component along a second direction and a third direction. The cover presses the elastic component on the casing along the third direction, wherein the first direction is perpendicular to the second direction, and the third direction is perpendicular to the first direction and the second direction.

According to an embodiment of the present invention, the module connector further includes a first pivoting portion and a second pivoting portion, connected to the casing and respectively having a first pivoting hole and a second pivoting hole, wherein a back end of the cover has a first axial portion and a second axial portion opposite to each other. The back end is located between the first pivoting portion and the second pivoting portion, and the first axial portion and the second axial portion are pivoted with the first pivoting hole and the second pivoting hole respectively.

According to an embodiment of the present invention, the first pivoting portion has a slot. The slot is connected to the first pivoting hole. The first pivoting hole opens at a side edge of the first pivoting portion through the slot. When the second axial portion is located in the second pivoting hole, the first axial portion is adapted to pass through the slot to be moved into or moved out of the first pivoting hole.

According to an embodiment of the present invention, the first axial portion has a side. An outer diameter of the first axial portion along a direction perpendicular to the side is smaller than an inner diameter of the slot. An outer diameter of the first axial portion along any directions other than the direction is greater than the inner diameter of the slot, when the side is parallel to an extension direction of the slot, the first axial portion is adapted to pass through the slot to be moved into or moved out of the first pivoting hole, and when the first axial portion is located in the first pivoting hole and the side is not parallel to the extension direction of the slot, the first axial portion is restrained within the first pivoting hole.

According to an embodiment of the present invention, a rotating range of the cover is restrained between the first position and the second position, and when the cover is located within the rotating range, the side is not parallel to the extension direction of the slot.

According to an embodiment of the present invention, the cover has at least one protrusion, and the cover is adapted to rotate from the first position to the second position along a first rotating direction. When the cover is located at the second position, the protrusion and the casing are structurally interfered with each other to stop the cover from rotating along the first rotating direction.

According to an embodiment of the present invention, the connector module further includes a locking hook. The locking hook is connected to the casing. The cover is adapted to rotate from the second position to the first position along a second rotating direction, and when the cover is located at the first position, the cover and the locking hook are structurally interfered with each other to stop the cover from rotating along the second rotating direction.

According to an embodiment of the present invention, the connector main body has an open end. The open end is aligned with the notch. When the cover is located at the second position to expose the notch, the open end and the notch form a socket, and an external connector is adapted to be plugged into the connector main body through the socket.

Based on the description above, in the connector module of the present invention, the elastic component is disposed at the gap between the first position-limiting portion and the second position-limiting portion and partially inserted into the position-limiting hole of the first position-limiting portion, and the cover presses the elastic component onto the casing. Thereby, the elastic component is disposed at the casing by the structural interference of the first position-limiting portion, the second position-limiting portion and the cover. Thus, no fusion process is needed to perform the assembly thereof, such that the connector module is easy to be assembled and disassembled.

To make the above features and advantages of the invention more comprehensible, several embodiments accompanied with drawings are described in detail as follows.

DESCRIPTION OF EMBODIMENTS

Figure 1:
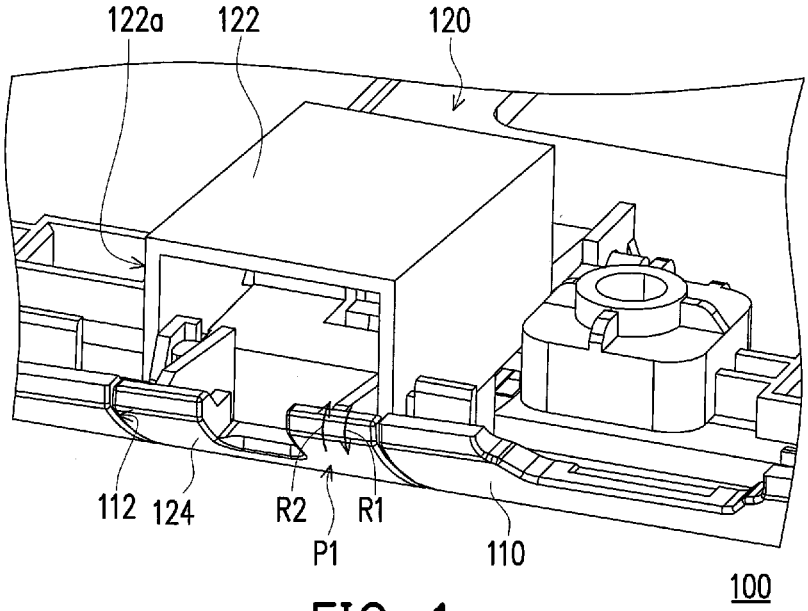
FIG. 1 is a partial perspective view of an electronic device according to one embodiment of the invention.

FIG. 1 is a partial perspective view of an electronic device according to one embodiment of the invention. Referring to FIG. 1, the electronic device 100 of the present embodiment is, for example, a host of a notebook computer. The electronic device 100 includes a casing 110 and a connector module 120. The casing 110 is, for example, a bottom casing of the notebook computer, having a notch 112. The connector module 120 includes a connector main body 122 and a cover 124. The connector main body 122 is, for example, a network connector. The connector main body 122 is disposed on the casing 110 and corresponds to the notch 112 of the casing 110. The cover 124 is pivoted with the casing 110, and able to cover or expose the notch 112, which will be described in detail as below.

Figure 2:
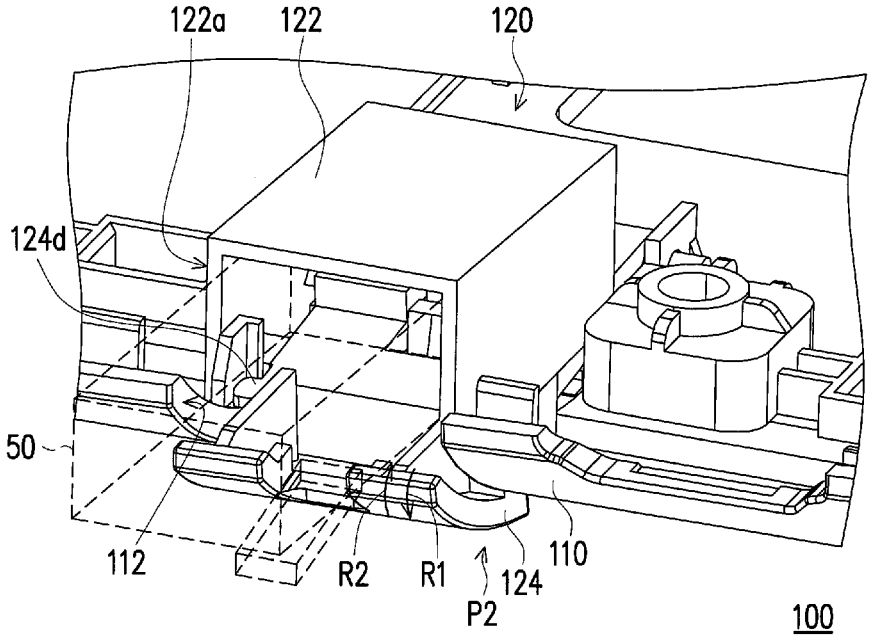
FIG. 2 is a schematic view of the cover exposing the notch in FIG. 1.

FIG. 2 is a schematic view of the cover exposing the notch in FIG. 1. The cover 124 is adapted to rotate to a first position P1 shown in FIG. 1 to cover the notch 112, or rotate to a second position P2 shown in FIG. 2 to expose the notch 112. The connector main body 122 has an open end 122*a*. The open end 122*a* corresponds to the notch 112. When the cover 124 is located at the second position P2 to expose the notch 112, the open end 122*a* of the connector main body 122 and the notch 112 of the casing 110 form a socket, and an external connector 50, for example, a plug of a network cable, is adapted to be plugged into the connector main body 122 through the socket.

Figure 3:
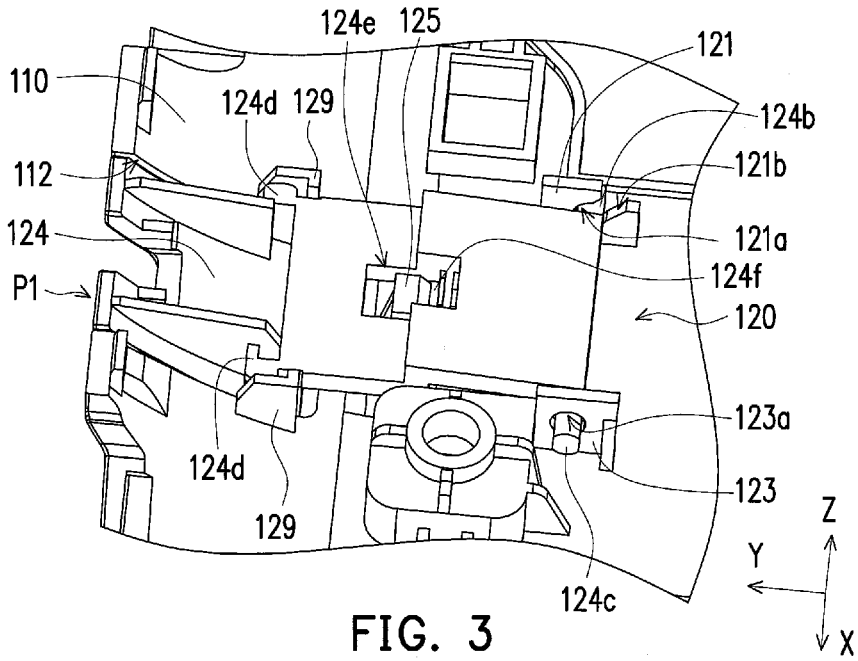
FIG. 3 is a perspective view of a part of the components of the electronic device in FIG. 1.
Figure 4:
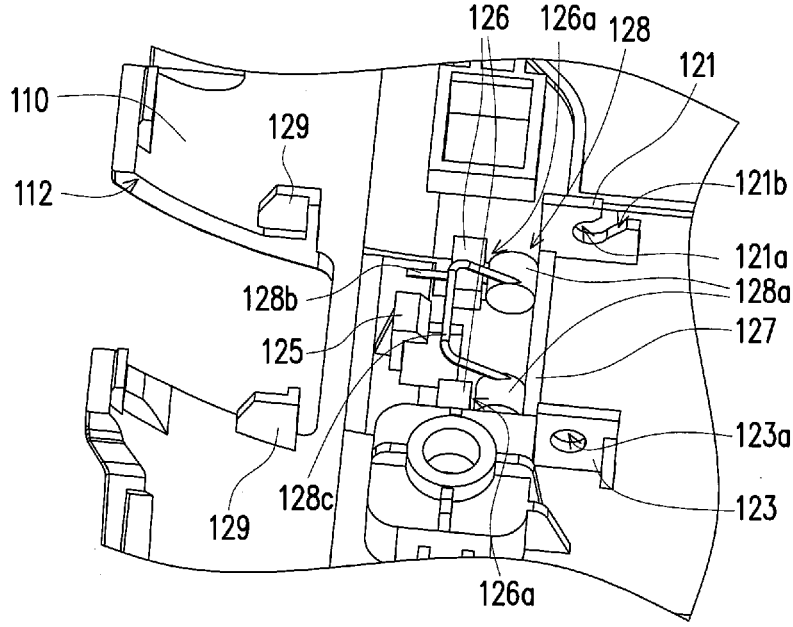
FIG. 4 is a perspective view of a part of the components of the electronic device in FIG. 3.
Figure 5:
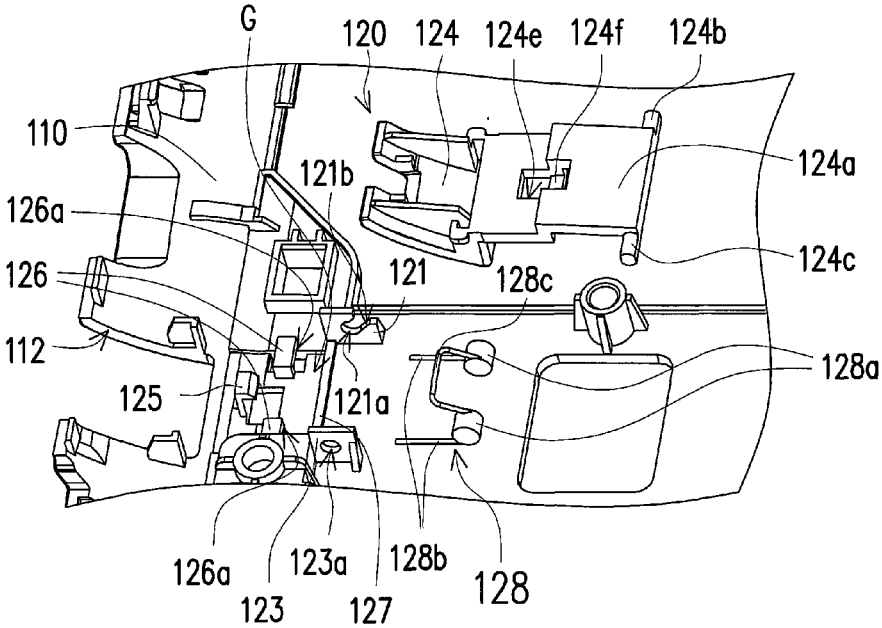
FIG. 5 is an exploded view of the electronic device in FIG. 3.

FIG. 3 is a perspective view of a part of the components of the electronic device in FIG. 1. FIG. 4 is a perspective view of a part of the components of the electronic device in FIG. 3. FIG. 5 is an exploded view of the electronic device in FIG. 3. The connector main body 122 in FIG. 1 and FIG. 2 are not shown in FIG. 3 to FIG. 5 for better and clearer illustration. Referring to FIG. 3 to FIG. 5, the connector module 120 of the present embodiment further includes a first position-limiting portion 126, a second position-limiting portion 127 and an elastic component 128. The first position-limiting portion 126 and the second position-limiting portion 127 are integrally formed with and connected to the casing 110. The first position-limiting portion 126 has at least one position-limiting hole 126*a* (two are illustrated). A gap G is formed between the first position-limiting portion 126 and the second position-limiting portion 127. The elastic component 128 is disposed at the gap G between the first position-limiting portion 126 and the second position-limiting portion 127 and partially inserted into the position-limiting hole 126*a*, and the cover 124 presses the elastic component 128 onto the casing 110. A user may use the external connector 50 to resist the elastic force of the elastic component 128, so as to push the cover 124 from the first position P1 shown in FIG. 1 to the second position P2 shown in FIG. 2, such that the external connector 50 can be plugged into the connector main body 122 successfully. When the external connector 50 is removed, the cover 124 is restored from the second position P2 to the first position P1 by the elastic force of the elastic component 128.

To be more specific, in the present embodiment, the elastic component 128 is, for example, a torsion spring and includes at least one spring body 128*a* (two are illustrated), at least one first spring arm 128*b* (two are illustrated) and a second spring arm 128*c*. The elastic component 128 is connected between the first spring arms 128*b* and the second spring arm 128*c*, and located at the gap G between the first position-limiting portion 126 and the second position-limiting portion 127. The first spring arm 128*b* is inserted into the position-limiting hole 126*a*, and the cover 124 leans against the second spring arm 128*c*. With the disposition, the first position-limiting portion 126 and the second position-limiting portion 127 restrain the moving range of the elastic component 128 along a first direction Y (illustrated in FIG. 3). The position-limiting hole 126*a* restrains the moving ranges of the elastic component 128 along a second direction X (illustrated in FIG. 3) and a third direction Z (illustrated in FIG. 3). The cover 124 presses the elastic component 128 onto the casing 110 along the third direction Z. Herein, the first direction Y is perpendicular to the second direction X, and the third direction Z is perpendicular to the first direction Y and the second direction Z. Thereby, the elastic component 128 is disposed on the casing 110 by the structural interference of the first position-limiting portion 126, the second position-limiting portion 127 and the cover 124. Thus, no fusion process is needed to perform the assembly thereof, such that the connector module 120 is easy to be assembled and disassembled.

Referring to FIG. 3 to FIG. 5, in the present embodiment, the connector module 120 further includes a first pivoting portion 121 and a second pivoting portion 123. The first pivoting portion 121 and the second pivoting portion 126 are integrally formed with and connected to the casing 110 and have a first pivoting hole 121*a* and a second pivoting hole 123*a* respectively. A back end 124*a* of the cover 124 has a first axial portion 124*b* and a second axial portion 124*c* opposite to each other. The back end 124*a* of the cover 124 is located between the first pivoting portion 121 and the second pivoting portion 123, and the first axial portion 124*b* and the second axial portion 124*c* are pivoted with the first pivoting hole 121*a* and the second pivoting hole 123*a* respectively, such that the cover 124 can rotate about the first axial portion 124*b* and the second axial portion 124*c*. The first pivoting portion 121 of the present embodiment has a slot 121*b*. The slot 121*b* is connected to the first pivoting hole 121*a*. The first pivoting hole 121*a* opens at a side edge of the first pivoting portion 121 through the slot 121*b*, such that the first pivoting portion 121 is in an open-circle formation for the first axial portion 124*b* to pass through the slot 121*b* to be moved into the first pivoting hole 121*a*. In addition, the second pivoting portion 126 does not have a slot and is in a close-circle formation, so as to avoid the second axial portion 124*c* being separated from the second pivoting portion 123.

Figure 6:
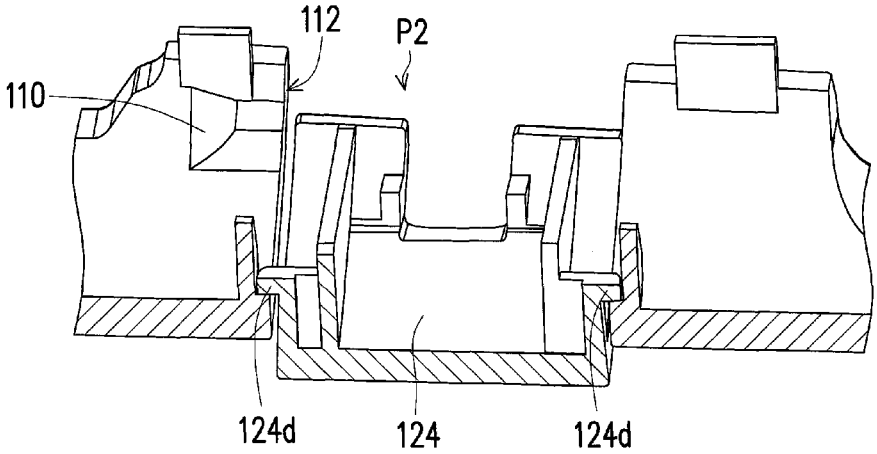
FIG. 6 is a partial view of the electronic device in FIG. 2.

Referring to FIG. 1 and FIG. 2, the cover 124 is adapted to rotate from the first position P1 to the second position P2 along a first rotating direction R1, and is adapted to rotate from the second position P2 to the first position P1 along a second rotating direction R2. FIG. 6 is a partial view of the electronic device in FIG. 2. Referring to FIG. 3 and FIG. 6, the cover 124 of the present embodiment has at least one protrusion 124*a* (two are illustrated). When the cover 124 is located at the second position P2 as shown in FIG. 2 and FIG. 6, the protrusion 124*d* and the casing 110 are structurally interfered with each other as shown in FIG. 6 to stop the cover 124 from rotating along the first rotating direction R1. In the present embodiment, the connector module 120 further includes two position-limiting blocks 129, the two position-limiting blocks 129 correspond to the two protrusions 124*d* of the cover 124 respectively, so as to further ensure the cover 124 not wobbling along the second direction X.

Referring to FIG. 3 to FIG. 5, the connector module 120 of the present embodiment further includes a locking hook 125. The locking hook 125 is integrally formed with and connected to the casing 110. When the cover 124 is located at the first position P1 as shown in FIG. 1 and FIG. 3, the cover 124 and the locking hook 125 are structurally interfered with each other to stop the cover 124 from rotating along the second rotating direction R2. In the present embodiment, the cover 124 has an opening 124*e* and a pin 124*f*. The pin 124*f* is located in the opening 124*e*. The locking hook 125 is adapted to be inserted into the opening 124*e* and locked with the pin 124*f*, so as to be structurally interfered with the cover 124.

Figure 7A:
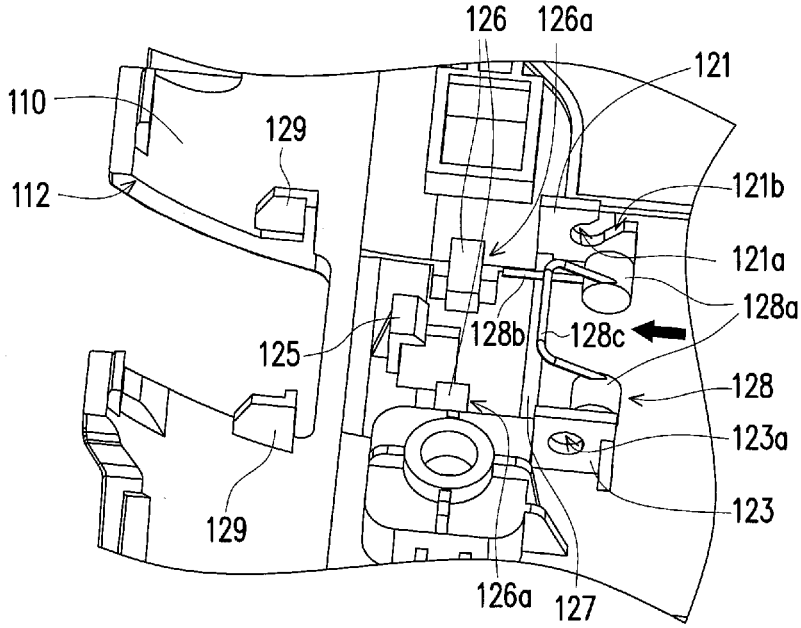
FIGS. 7A and 7B are schematic views of the assembly method of the connector module in FIG. 3.
Figure 7B:
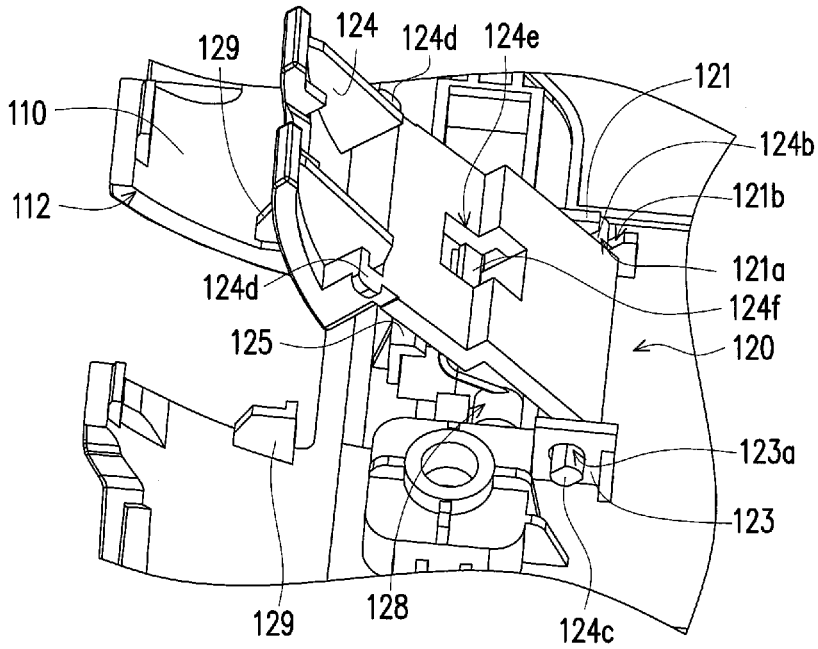

The assembly method of the elastic component 128 and the cover 124 of the present embodiment are provided as follows to illustrate in detail respectively with figures. FIG. 7A and FIG. 7B are schematic views of the assembly method of the connector module in FIG. 3. First of all, the first spring arms 128*b* of the elastic component 128 is inserted into the position-limiting hole 126*a* of the first position-limiting portion 126 along the direction of the arrow shown in FIG. 7A to change to the state shown in FIG. 4. At the time, the elastic component 128 is fixed to the casing 110 by the first position-limiting portion 126 and the second position-limiting portion 127. Next, the second axial portion 124*c* of the cover 124 is inserted into the second pivoting hole 123*a* of the second pivoting portion 123, as shown in FIG. 7B. When the second axial portion 124*c* is located in the second pivoting hole 123*a*, the first axial portion 124*b* passes through the slot 121*b* of the first pivoting portion 121 to be moved into the first pivoting hole 121*a*. Then, the cover 124 is pressed from the state shown in FIG. 7B down to the state shown in FIG. 3B by resisting the elastic force of the elastic component. Meanwhile, the cover 124 is locked by the locking hook 125 and presses the elastic component 128 onto the casing 110, so as to finish the assembly of the elastic component 128 and the cover 124.

Figure 8:
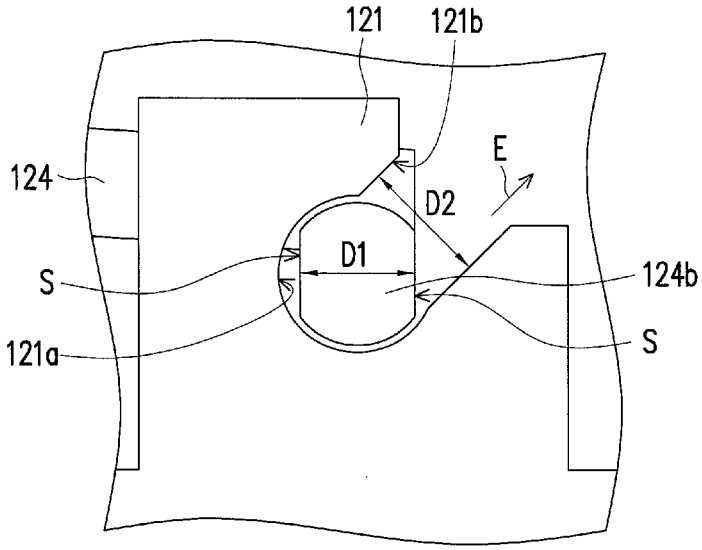
FIG. 8 is a schematic view of the first pivoting portion and the first axial portion in FIG. 3.
Figure 9:
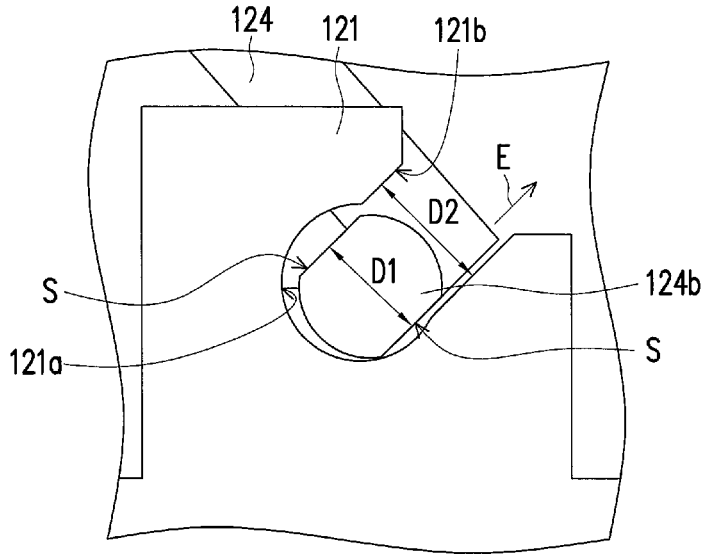
FIG. 9 is a schematic view of the first pivoting portion and the first axial portion in FIG. 7B.

FIG. 8 is a schematic view of the first pivoting portion and the first axial portion in FIG. 3. FIG. 9 is a schematic view of the first pivoting portion and the first axial portion in FIG. 7B. Referring to FIG. 8 and FIG. 9, the first axial portion 124*b* of the present embodiment has at least one side S (two are illustrated). An outer diameter D1 of the first axial portion 124*b* along a direction perpendicular to the side S is smaller than an inner diameter D2 of the slot 121*b* of the first pivoting portion 121, and an outer diameter of the first axial portion 124*b* along any directions other than the direction perpendicular to the side S is greater than the inner diameter D2 of the slot 121*b*. With the design described above, when the side S of the first axial portion 124*b*, as shown in FIG. 9, is parallel to an extension direction E of the slot 121*b*, the first axial portion 124*b* can pass through the slot 121*b* to be moved into or moved out of the first pivoting hole 121*a*, such that the cover 124 is easy to be assembled and disassembled. When the first axial portion 124*b* is located within the first pivoting hole 121*a* and the cover 124 is pressed from the state shown in FIG. 7B down to the state shown in FIG. 3, the side S, as shown in FIG. 8, is not parallel to the extension direction E of the slot 121*b*. Meanwhile, the first axial portion 124*b* can not pass through the slot 121*b* and is restrained in the first pivoting hole 121*a*.

In the present embodiment, after the cover 124 is assembled, the rotating range of the cover 124 is restrained between the first position P1 shown in FIG. 1 and the second position P2 shown in FIG. 2. When the cover 124 is located within the rotating range described above, the side 0 of the first axial portion 124*b* is not parallel to the extension direction E of the slot 121*b* because the cover 124 does not rotate to the states shown in FIG. 7B and FIG. 9, so as to ensure the first axial portion 124*b* restrained in the first pivoting hole 121*a* and keep the first axial portion 124*b* from shedding.

The disassembly method of the elastic component 128 and the cover 124 will be described in detail as follow. First of all, a force is applied on the cover shown in FIG. 3, such that the cover 124 is separated from the locking hook 125. Next, the cover 124 is lifted up to the state shown in FIG. 7B, such that the first axial portion 124*b* rotates to the state shown in FIG. 9. Meanwhile, the side S of the first axial portion 124*b* is parallel to the extension direction E of the slot 121*b*, such that the first axial portion 124*b* can pass through the slot 121*b* via the smaller outer diameter D1 thereof to be moved out of the first pivoting hole 121*a*. After the first axial portion 124*b* is moved out of the first pivoting hole 121*a*, the second axial portion 124*c* is moved out of the second pivoting hole 123*a*, so as to finish the disassembly of the cover 124. When the cover 124 is moved away to expose the elastic component 128 as shown in FIG. 4, the elastic component 128 is no longer pressed by the cover 124, and able to be disassembled from the casing 110. The cover 124 and the elastic component 128 can be easily disassembled since the connector module 120 is not assembled by fusion process, so as to avoid putting a whole bottom casing of a notebook computer to total waste due to defect or damage of the cover 124 and the elastic component.

In sum, in the connector module of the present invention, the spring body of the elastic component is disposed at the gap between the first position-limiting portion and the second position-limiting portion and is partially inserted into the position-limiting hole of the first position-limiting portion by the first spring arm thereof. The cover is disposed by the first pivoting portion, the second pivoting portion and the locking hook on the casing, and leans against the second spring arm of the elastic component to press the elastic component onto the casing. Thereby, the cover is disposed at the casing by the structural interference of the first pivoting portion, the second pivoting portion and the locking hook, and the elastic component is disposed at the casing by the structural interference of the first position-limiting portion, the second position-limiting portion and the cover. Thus, no fusion process is needed to perform the assembly thereof, such that the connector module is easy to be assembled and disassembled.

Although the present invention has been described with reference to the above embodiments, it will be apparent to one of ordinary skill in the art that modifications to the described embodiments may be made without departing from the spirit of the invention. Accordingly, the scope of the invention will be defined by the attached claims and not by the above detailed descriptions.

What is claimed is:

1. An electronic device, comprising:

a casing, having a notch; and a connector module, comprising:

a connector main body, disposed on the casing and corresponding to the notch;

a cover, pivoted with the casing, wherein the cover is adapted to rotate to a first position to cover the notch, or rotate to a second position to expose the notch;

a first position-limiting portion and a second position-limiting portion, connected to the casing, wherein the first position-limiting portion has at least one position-limiting hole, and a gap is formed between the first position-limiting portion and the second position-limiting portion; and an elastic component, disposed at the gap and partially inserted into the position-limiting hole, wherein the cover presses the elastic component onto the casing and is adapted to restore from the second position to the first position by elastic force of the elastic component.

2. The electronic device as claimed in claim 1, wherein the elastic component is a torsion spring and comprises at least one spring body, at least one first spring arm and a second spring arm, the spring body is connected between the first sprig arm and the second spring arm and located at the gap, the first spring arm is inserted into the position-limiting hole, and the cover leans against the second spring arm.

3. The electronic device as claimed in claim 1, wherein the first position-limiting portion and the second position-limiting portion restrain a moving range of the elastic component along a first direction, the position-limiting hole restrains moving ranges of the elastic component along a second direction and a third direction, the cover presses the elastic component onto the casing along the third direction, the first direction is perpendicular to the second direction, and the third direction is perpendicular to the first direction and the second direction.

4. The electronic device as claimed in claim 1, wherein the connector module further comprises a first pivoting portion and a second pivoting portion, connected to the casing and respectively having a first pivoting hole and a second pivoting hole, wherein a back end of the cover has a first axial portion and a second axial portion opposite to each other, the back end is located between the first pivoting portion and the second pivoting portion, and the first axial portion and the second axial portion are pivoted with the first pivoting hole and the second pivoting hole respectively.

5. The electronic device as claimed in claim 4, wherein the first pivoting portion has a slot, the slot is connected to the first pivoting hole, the first pivoting hole opens at a side edge of the first pivoting portion through the slot, and when the second axial portion is located in the second pivoting hole, the first axial portion is adapted to pass through the slot to be moved into the first pivoting hole.

6. The electronic device as claimed in claim 5, wherein the first axial portion has a side, an outer diameter of the first axial portion along a direction perpendicular to the side is smaller than an inner diameter of the slot, an outer diameter of the first axial portion along any directions other than the direction is greater than the inner diameter of the slot, when the side is parallel to an extension direction of the slot, the first axial portion is adapted to pass through the slot to be moved into or moved out of the first pivoting hole, and when the first axial portion is located in the first pivoting hole and the side is not parallel to the extension direction of the slot, the first axial portion is restrained within the first pivoting hole.

7. The electronic device as claimed in claim 6, wherein a rotating range of the cover is restrained between the first position and the second position, and when the cover is located within the rotating range, the side is not parallel to the extension direction of the slot.

8. The electronic device as claimed in claim 1, wherein the cover has at least one protrusion, the cover is adapted to rotate from the first position to the second position along a first rotating direction, and when the cover is located at the second position, the protrusion and the casing are structurally interfered with each other to stop the cover from rotating along the first rotating direction.

9. The electronic device as claimed in claim 1, wherein the connector module further comprises a locking hook, the locking hook is connected to the casing, the cover is adapted to rotate from the second position to the first position along a second rotating direction, and when the cover is located at the first position, the cover and the locking hook are structurally interfered with each other to stop the cover from rotating along the second rotating direction.

10. The electronic device as claimed in claim 1, wherein the connector main body has an open end, the open end is aligned with the notch, when the cover is located at the second position to expose the notch, the open end and the notch form a socket, and an external connector is adapted to be plugged into the connector main body through the socket.

11. A connector module, adapted for an electronic device, the electronic device comprising a casing, the casing having a notch, the connector module comprising:

a connector main body, disposed on the casing and corresponding to the notch;

a cover, pivoted with the casing, wherein the cover is adapted to rotate to a first position to cover the notch, or rotate to a second position to expose the notch;

a first position-limiting portion and a second position-limiting portion, connected to the casing, wherein the first position-limiting portion has at least one position-limiting hole, and a gap is formed between the first position-limiting portion and the second position-limiting portion; and an elastic component, disposed at the gap and partially inserted into the position-limiting hole, wherein the cover presses the elastic component onto the casing and is adapted to restore from the second position to the first position by elastic force of the elastic component.

12. The connector module as claimed in claim 11, wherein the elastic component is a torsion spring and comprises at least one spring body, at least one first spring arm and a second spring arm, the spring body is connected between the first sprig arm and the second spring arm and located at the gap, the first spring arm is inserted into the position-limiting hole, and the cover leans against the second spring arm.

13. The connector module as claimed in claim 11, wherein the first position-limiting portion and the second position-limiting portion restrain a moving range of the elastic component along a first direction, the position-limiting hole restrains moving ranges of the elastic component along a second direction and a third direction, the cover presses the elastic component onto the casing along the third direction, the first direction is perpendicular to the second direction, and the third direction is perpendicular to the first direction and the second direction.

14. The connector module as claimed in claim 11, further comprising a first pivoting portion and a second pivoting portion, connected to the casing and respectively having a first pivoting hole and a second pivoting hole, wherein a back end of the cover has a first axial portion and a second axial portion opposite to each other, the back end is located between the first pivoting portion and the second pivoting portion, and the first axial portion and the second axial portion are pivoted with the first pivoting hole and the second pivoting hole respectively.

15. The connector module as claimed in claim 14, wherein the first pivoting portion has a slot, the slot is connected to the first pivoting hole, the first pivoting hole opens at a side edge of the first pivoting portion through the slot, and when the second axial portion is located in the second pivoting hole, the first axial portion is adapted to pass through the slot to be moved into the first pivoting hole.

16. The connector module as claimed in claim 15, wherein the first axial portion has a side, an outer diameter of the first axial portion along a direction perpendicular to the side is smaller than an inner diameter of the slot, an outer diameter of the first axial portion along any directions other than the direction is greater than the inner diameter of the slot, when the side is parallel to an extension direction of the slot, the first axial portion is adapted to pass through the slot to be moved into or moved out of the first pivoting hole, and when the first axial portion is located in the first pivoting hole and the side is not parallel to the extension direction of the slot, the first axial portion is restrained within the first pivoting hole.

17. The connector module as claimed in claim 16, wherein a rotating range of the cover is restrained between the first position and the second position, and when the cover is located within the rotating range, the side is not parallel to the extension direction of the slot.

18. The connector module as claimed in claim 11, wherein the cover has at least one protrusion, the cover is adapted to rotate from the first position to the second position along a first rotating direction, and when the cover is located at the second position, the protrusion and the casing are structurally interfered with each other to stop the cover from rotating along the first rotating direction.

19. The connector module as claimed in claim 11, further comprising a locking hook, wherein the locking hook is connected to the casing, the cover is adapted to rotate from the second position to the first position along a second rotating direction, and when the cover is located at the first position, the cover and the locking hook are structurally interfered with each other to stop the cover from rotating along the second rotating direction.

20. The connector module as claimed in claim 11, wherein the connector main body has an open end, the open end is aligned with the notch, when the cover is located at the second position to expose the notch, the open end and the notch form a socket, and an external connector is adapted to be plugged into the connector main body through the socket.

* * * * *